252-99 AU 166 EX
2/23/82 OR 4,316,812

United States Patent [19]

Hancock et al.

[11] 4,316,812

[45] Feb. 23, 1982

[54] DETERGENT COMPOSITION

[75] Inventors: Roger I. Hancock, Stockton; Kathleen M. Morrison, Saltburn, both of England

[73] Assignee: Imperial Chemical Industries Limited, London, England

[21] Appl. No.: 100,041

[22] Filed: Dec. 4, 1979

Related U.S. Application Data

[63] Continuation-in-part of Ser. No. 911,517, Jun. 1, 1978, abandoned.

[30] Foreign Application Priority Data

Jun. 9, 1977 [GB] United Kingdom ..... 24083/77

[51] Int. Cl.[3] ..... C11D 7/54

[52] U.S. Cl. ..... 252/99; 252/135; 252/DIG. 1; 252/DIG. 14

[58] Field of Search ..... 252/99, DIG. 1, DIG. 14, 252/135

[56] References Cited

U.S. PATENT DOCUMENTS 3,720,621 3/1973 Smeets ..... 252/99 X 4,107,067 8/1978 Murphy et al. ..... 252/DIG. 14

*Primary Examiner*—Mayer Weinblatt

*Attorney, Agent, or Firm*—Cushman, Darby & Cushman

[57] ABSTRACT

A liquid detergent composition which comprises a dispersion of solids comprising one or more builders and a bleach, the solids having an average particle diameter of less than 10 microns in a substantially water free non-ionic liquid surfactant which has a pour point of less than 10° C. is stable in the absence of dispersing agents for the solids.

8 Claims, No Drawings

DETERGENT COMPOSITION

This application is a continuation-in-part of our copending U.S. patent application Ser. No. 911,517 filed June 1, 1978, now abandoned.

The present invention relates to a detergent composition, in particular to an anhydrous non-ionic detergent composition containing builders.

Heavy duty detergent compositions for use, for example, in domestic washing machines are commonly sold in the form of powders. The advantage of a powder is that it enables a wide range of inorganic builders to be incorporated into the composition, wider than if an aqueous composition were formulated because some builders e.g. sodium tripolyphosphate are unstable in the presence of water and bleaches e.g. sodium or potassium perborate or percarbonate in the presence of water oxidise organic components of the composition. It is also difficult to formulate a homogeneous liquid aqueous composition with organic surfactant and the desired quantity of inorganic builders. The disadvantages of a powder from the manufacturer's point of view is that it is relatively expensive to make. Compared with an equivalent aqueous composition a powder requires expensive drying equipment for its production, and as well as being expensive such equipment is often difficult and sometimes hazardous to operate.

We have now devised a composition which is liquid and which contains organic surfactants and builders of the type, and in the concentration, which heretofor has only been achieved in powder form.

According to the invention a liquid detergent composition comprises a dispersion of solids comprising a builder preferably sodium or potassium tripolyphosphate and a bleach which is preferably sodium or potassium perborate or percarbonate the average particle diameter being at most 10 microns and preferably at most 5 microns in a substantially water free non-ionic liquid surfactant which has a pour point of less than 10° C.

The pour point may be measured by ASTM test method designation D97-66 reapproved 1971.

Any builder which is known for use in detergent compositions may be used in the composition according to the present invention. Generally such builders are inorganic in nature but some organic products in particular sodium carboxymethylcellulose may be used. Suitable inorganic builders include phosphates, e.g. trisodium phosphate, tetrasodium pyrophosphate, sodium hexametaphosphate and, preferably, sodium tripolyphosphate, carbonates e.g. sodium carbonate, sodium bicarbonate and sodium sesquicarbonate, clays e.g. kaolin, montmorillonites and sodium bentonite, miscellaneous salts e.g. sodium borate, sodium citrate and sodium meta-silicate, and nitrilotriacetic acid. The potassium analogues of these sodium compounds may also be used.

In order to prove an effective dispersion of the solids in the liquid non-ionic surfactant it is desirable that at least 90% of the particles of the solids have particle sizes of less than 10 microns in diameter. The composition may contain a dispersant to facilitate and to stabilise the dispersion if desired but surprisingly we have found that no dispersant is necessary. A suitable dispersant may be a finely divided silica (5 to 100 preferably 7 to 40 millimicrons diameter particles) such as it sold under the trade name AEROSIL.

The non-ionic surfactant which is a component of the composition according to the invention is preferably an alkylene oxide derivative. In particular, the non-ionic surfactant may be an alkylene oxide derivative of an amide, alkyl phenol or an alkanol. The alkyl group in the alkyl phenol may be straight chain or branched chain and may contain from 6 to 20 carbon atoms e.g. para-nonyl phenol or para-dodecylphenol. The alkanol may contain 6 to 20 carbon atoms, particularly 10 to 16 carbon atoms. The alcohol is preferably a primary or secondary alkanol having a linear or mono branched alkyl group.

The composition may usefully comprise two non-ionic surfactants, one of which fulfills a surfactant function and the other of which both fulfills a surfactant function and reduces the pour point of the composition. The former surfactant may for example comprise alcohols having 12 to 16 carbon atoms which have been alkoxylated with 5 to 15 moles of ethylene and/or propylene oxide; the other surfactant may be a linear or branched chain $C_{6-11}$ alcohol alkoxylate which comprises 2 to 8 moles of ethylene and/or propylene oxide per mole, branched chain alcohols being preferred in the $C_{8-11}$ range and linear alcohols being preferred in the $C_{6-8}$ range, or an alkyl phenol alkoxylate having 2 to 6 moles of ethylene and/or propylene oxide per molecule the alkyl group suitably being in a para-position and having 6 to 12 carbon atoms.

A further surfactant of the anionic or cationic type may be included if desired. Such anionic or cationic surfactants may be of known type for example the anionic detergents may be soaps, alkylbenzene or olefine sulphonates, alcohol sulphates or alcohol alkoxylate sulphates; the cationic surfactants are suitably di-$C_{14-20}$ and preferably di-$C_{16-18}$ alkyl, di-lower alkyl ammonium salts or hydroxides for example chlorides or sulphates. The lower alkyl groups are suitably methyl groups.

In general the alkylphenol or alkanol derivative may comprise 2 to 20 alkylene oxide units which are preferably ethylene oxide units although a minor number of propylene oxide or a lesser number of butylene oxide units may also be present. The amide is suitably a mono- or di-alkanol amide e.g. a mono- or di-ethanolamide preferably of a $C_6$ to $C_{30}$ more preferably $C_{10}$ to $C_{20}$ alkanoic acid, e.g. coconut acids, tallow acids or stearic acid. An alternative non-ionic surfactant for use in a composition according to the invention comprises a copolymer of ethylene oxide with propylene oxide and/or butylene oxide. The copolymer comprises a block of propylene and/or butylene oxide units on to which is grafted the ethylene oxide. The block preferably comprises 20 to 40 propylene oxide units, particularly about 30 such units and 20 to 30 particularly about 26 ethylene oxide units.

It is a feature of the composition according to the invention that the dispersion of the solids in the non-ionic surfactant is particularly stable. If the solids do separate at all then the resulting phase is loosely flocculated and is readily redispersible while if the relative amounts of the solids and non-ionic surfactant in the composition is correctly chosen there is little phase separation as the liquid fills the space between the loosely packed solid particles. The composition may contain 20 to 70% by weight builder(s). It is preferred that the composition contain 30 to 60% and more preferably 40 to 60% by weight builder(s). The composition preferably contains 1 to 20% and more preferably 2 to 15% by weight of bleach. The remainder is preferably substantially non-ionic surfactant. The composition may also contain additives conventionally found in detergent compositions e.g. optical brighteners, ethylene diamine tetra acetic acid, dyes, perfumes or enzymes.

The invention will now be further described with reference to the following Examples:

EXAMPLE 1

Compositions were made up comprising:

| | |
|---|---|
| Builders* | 42 parts and 45 parts by weight |
| Non-ionic surfactant** | 58 parts and 55 parts by weight |
| Polyethylene glycol (m.wt 80,000) | 1 part and 1 part by weight |

*The builders were sodium tripolyphosphate 82.3% w/w sodium silicate 15.2% w/w sodium carbonate 2.4% w/w

**The non-ionic surfactant comprised a mixture of 87.4% w/w alcohol alkoxylates (derived from a mixture of $C_{13}$ and $C_{15}$ primary alcohols comprising 55% straight chain and 45% chain with a methyl branch in the 2-position alkoxylated with a mixture of ethylene oxide (92% w/w) and propylene oxide (8% w/w) to give an average alkylene oxide chain length of 9). 10.9% w/w coconut acids diethanolamide and 1.7% w/w "Fluolite" (optical brightener). "Fluolite" is a trade mark.

by mixing the components together and then stirring for 20 minutes with a high shear homogeniser. 2 parts by weight finely divided silica (AEROSIL) were then added and mixed into the composition by stirring for the minimum period of time.

The two compositions were stable and the dispersion did not break even after 3 weeks storage at 0° C., ambient temperature, or 50° C.

In washing tests the compositions proved to be approximately as effective, under comparable conditions, as three different commercial powders.

EXAMPLE 2

Compositions were made up from the following components:

| | |
|---|---|
| Sodium tripolyphosphate | 30 parts by weight |
| Sodium metasilicate | 2 parts by weight |
| Sodium percarbonate | 8 parts by weight |
| $C_{10}$ alcohol derived by hydroformylation of propylene trimer and ethoxylated with an average of 6 ethylene oxide units per molecule. | 10.5 parts by weight |
| A surfactant mixture comprising 87.4% w/w alcohol alkoxylates (derived from a mixture of $C_{13}$ and $C_{15}$ primary alcohols comprising 55% straight chain and 45% with a methyl branch in the 2-position alkoxylated with a mixture of ethylene oxide (92% w/w) and propylene oxide (8% w/w) to give an average alkylene oxide chain length of 7). | 42 parts by weight |
| Coconut acid diethanolamide | 6.5 parts by weight |
| "FLUOLITE"* (optical brightener) | 1.0 parts by weight |
| AEROSIL* | 2.5 parts by weight |

*FLUOLITE and AEROSIL are trade marks

In the second composition the ethoxylated isodecanol was replaced by an ethoxylate of a mixture of $C_7$ to $C_9$ primary alcohols comprising approximately 30% w/w linear, 60% w/w branched and 10% w/w alicyclic alcohols. The ethoxylate contained an average of 6 ethylene oxide units per molecule.

The two formulations were stable and the dispersions did not break after 3 weeks storage at 0° C., ambient temperature and 50° C. respectively, while the washing ability of the two compositions were comparable with commercial powders.

It should also be noted that the dispersant used in the two formulations described above was "AEROSIL" alone as compared with the dispersant described in Example 1 which comprised "AEROSIL" and a polyethylene glycol.

EXAMPLE 3

Four compositions according to the invention were made up as in Example 1, using the following components:

| | |
|---|---|
| Composition(a) | |
| "Synperonic" 87K* | 49% by weight |
| A mixture of straight and branched chain primary $C_7$, $C_8$ and $C_9$ aliphatic and alicyclic alcohols ethoxylated with an average of 6 moles of ethylene oxide ("Alphanol" 6) | 11% by weight |
| Sodium tripolyphosphate | 25% by weight |
| Sodium silicate | 3% by weight |
| Sodium percarbonate | 7% by weight |
| Carboxymethylcellulose | 1% by weight |
| "Fluolite" optical brightener | 1% by weight |
| Ethylene diamine tetra acetic acid (di-sodium salt) | 1% by weight |
| "Aerosil" dispersant | 2% by weight |
| Composition(b) | |
| "Synperonic" 87K* | 31% by weight |
| "Alphanol" 6 | 8% by weight |
| Sodium tripolyphosphate | 41% by weight |
| Sodium percarbonate | 10% by weight |
| Sodium silicate | 5% by weight |
| Carboxymethylcellulose | 1% by weight |
| Ethylene diamine tetra acetic acid (di-sodium salt) | 1% by weight |
| "Fluolite" optical brightener | 1% by weight |
| "Aerosil" dispersant | 2% by weight |

The above compositions are low foam detergents suitable for use with automatic washing machines.

| | |
|---|---|
| Composition(c) | |
| "Synperonic" 87K* | 46% by weight |
| Dodecyl benzene sulphonate | 9% by weight |
| Sodium tripolyphosphate | 33% by weight |
| Sodium silicate | 6% by weight |
| Sodium carbonate | 1% by weight |
| Carboxymethylcellulose | 1% by weight |
| "Fluolite" optical brightener | 1% by weight |
| Ethylene diamine tetra acetic acid (di-sodium salt) | 1% by weight |
| "Aerosil" dispersant | 2% by weight |
| Composition(d) | |
| "Synperonic" 87K* | 48% by weight |
| A mixture of isomeric branched chain primary $C_{10}$ aliphatic alcohols ethoxylated to an average of 5 to 8 moles of ethylene oxide | 12% by weight |
| Sodium tripolyphosphate | 31% by weight |
| sodium percarbonate | 2% by weight |
| Sodium silicate | 2% by weight |
| Carboxymethylcellulose | 1% by weight |
| Ethylene diamine tetra acetic acid (di-sodium salt) | 1% by weight |
| "Fluolite" optical brightener | 1% by weight |
| "Aerosil" dispersant | 2% by weight |

Compositions (c) and (d) are high foam detergents suitable for use in twin-tub washing machines. The sodium tripolyphosphate, silicate and percarbonate were anhydrous in all cases.

The above compositions were tested in washing efficiency and compared with three well-known commercial washing powders by the following procedure.

Pieces of 4 inches by 3 inches standard soiled cotton cloth supplied by Krefeld were washed in 1 liter test solutions for 10 minutes at 50° C. and 100 revolutions per minute in a Terg-O-Tometer. The powders were used at a concentration of 5 grams per liter and the compositions of the invention at a concentration of 1.25 grams per liter. The light reflectance before and after washing was determined using a Gardner Reflectometer and the difference in reflectance before and after washing, which is a measure of the effectiveness of the washing process, was measured. The results were as follows:

Composition (a) reflectance change 29 units,
Composition (b) reflectance change 29 units,
Compositions (c) and (d) reflectance change 27 units.

The powder detergents gave reflectance changes of 30, 28 and 27 units respectively. These results indicate comparable washing efficiency using the products of this invention at the above concentrations.

EXAMPLE 4

A composition was made up as described in Example 1, from the following components:

| | |
|---|---|
| "Synperonic" 87K* | 41% by weight |
| "Alphanol" 6 | 9% by weight |
| Sodium tripolyphosphate (anhydrous) | 33% by weight |
| Sodium silicate (anhydrous) | 4% by weight |
| Sodium percarbonate (anhydrous) | 8% by weight |
| Carboxymethylcellulose | 1% by weight |
| Ethylene diamine tetra acetic acid (di-sodium salt) | 1% by weight |
| "Fluolite" optical brightener | 1% by weight |
| "Aerosil" dispersant | 2% by weight |

*A product of adding 7 moles of a mixture of ethylene oxide and propylene oxide in a molar proportion of 92 to 8 to a mixture of $C_{13}$ to $C_{15}$ primary alcohols of which 55% had straight chains and 45% 2-methylsubstituted chains. "Synperonic" and "Alphanol" are trade marks of Imperial Chemical Industries Limited.

The washing test of Example 3 was repeated using the above formulation and comparing it with the best of the powder detergents tested in Example 3, but using Empa soiled cotton test squares at 60° C. The reflectance change in the powder detergent was 21 units and with the formulation was 28 units.

EXAMPLE 5

A heavy duty laundry liquid was produced as follows: Sodium tripolyphosphate (40 g), sodium percarbonate (5 g) and miscellaneous ingredients (colour, perfume, optical brightener, carboxymethylcellulose and anti corrosion agents) (5 g) and polyethylene glycol (molecular weight 200, 5 g) were added to a non-ionic surfactant mixture (45 g) comprising a $C_{13}$ to $C_{15}$ primary alcohol alkoxylated to an average of 7 moles of alkylene oxide per mole of alcohol the alkylene oxide being a mixture of 8% propylene oxide and 92% ethylene oxide (36.6 g) and a $C_7$ to $C_9$ primary alcohol, average molecular weight 126 ethoxylated with six moles per mole of ethylene oxide (8.4 g) the mixture having a pour point of 7° C.

The whole of the ingredients were mixed by hand to form a stiff paste which was then mixed in a Silverson mixer and then a Dyno Mill bead mill to reduce the mean diameter of the particles to about 2.5 microns. The product was a suspension stable for at least three months, at the end of which there was slightly settling readily reversible by shaking.

The product was tested by measuring the change in reflectance of a standard soiled Krefeld cloth using a Gardner reflectometer brought about by washing the cloth in a Terg-O-Tometer manufactured by the US Testing Company, at 100 rpm for 10 minutes followed by hand rinsing.

RESULTS

| | Water Hardness ppm | | |
|---|---|---|---|
| | 50 | 300 | 150 |
| Polyester Cotton 60° C. | | | |
| Change in % reflectance on cleaning cloths | | | |
| Heavy duty liquid 1.25gm/liter | 18.0 | 10.8 | — |
| Heavy duty liquid 2.5 gm/liter | — | — | 17.9 |
| Market laundry powder 5.0gm liter | 11.6 | 8.7 | 10.8 |
| Cotton 60° C. | | | |
| Change in reflectance on cleaning cloths | | | |
| Heavy duty liquid 1.25gm/liter | 28.9 | — | — |
| Heavy duty liquid 2.5 gm/liter | | — | 31.1 |
| Market laundry powder 5.0gm/liter | 29.6 | — | 31.1 |

The composition of the invention thus shows superior washing performance with polyester/cotton and substantially equal performance with cotton compared with a commercially marketed laundry powder.

We claim:

1. A liquid detergent composition which comprises a dispersion of solids comprising one or more builders and an oxygen bleach, the solids having an average particle diameter of less than 10 microns in a substantially water free non-ionic liquid surfactant which has a pour point of less than 10° C. and no dispersant for the solids.

2. A composition as claimed in claim 1 in which the builder is sodium or potassium tripolyphosphate.

3. A composition as claimed in claim 1 in which at least 90% of the particles of the solids are less than 10 microns in diameter.

4. A composition as claimed in claim 3 in which the bleach is sodium or potassium perborate or percarbonate.

5. A composition as claimed in claim 4 in which the non-ionic surfactant is an alkoxylate of an amide, alkylphenol or alkanol.

6. A composition as claimed in claim 1, wherein said builder is selected from the group consisting of sodium carboxymethylcellulose, trisodium phosphate, tetrasodium pyrophosphate, sodium hexametaphosphate, sodium tripolyphosphate, sodium carbonate, sodium bicarbonate, sodium sesquicarbonate, kaolin, montmorillonites, sodium bentonite, sodium borate, sodium metasilicate, and the potassium analogues of said sodium compounds.

7. A stable, anhydrous, liquid detergent composition with its proportions consisting essentially of 20 to 70% by weight of builder, 1 to 20% by weight of an oxygen bleach and the remainder being substantially non-ionic surfactant, wherein:

(i) said builder is selected from the group consisting of sodium carboxymethylcellulose, trisodium phosphate, tetrasodium pyrophosphate, sodium hexametaphosphate, sodium tripolyphosphate, sodium carbonate, sodium bicarbonate, sodium sesquicarbonate, kaolin, montmorillonites, sodium bentonite, sodium borate, sodium metasilicate, and the potassium analogues of said sodium compounds; and (ii) said non-ionic surfactant is an alkoxylate of a $C_{12}$ to $C_{16}$ alcohol having 5 to 15 moles of ethylene and/or propylene oxide per mole of alkoxylate and an alkoxylate of a linear or branched chain $C_6$ to $C_{11}$ alcohol with 2 to 8 moles of ethylene oxide per mole and/or an alkoxylate of an alkyl phenol with 2 to 6 moles of ethylene and/or propylene oxides per mole, said alkyl group of said alkyl phenol having 6 to 12 carbon atoms.

8. A liquid detergent composition which comprises a dispersion of solids comprising a builder selected from the group consisting of sodium and potassium tripolyphosphate, and a bleach selected from the group consisting of sodium perborate, potassium perborate, sodium percarbonate and potassium percarbonate, the solids having an average particle diameter of less than 10 microns in a substantially water free non-ionic liquid surfactant having a pour point of less than 10° C. and which is an alkoxylate of a $C_{12}$ to $C_{16}$ alcohol with 5 to 15 moles of ethylene and/or propylene oxide per mole, and an alkoxylate of a linear or branched chain $C_6$ to $C_{11}$ alcohol with 2 to 8 moles of ethylene oxide per mole and/or an alkoxylate of an alkylphenol with 2 to 6 moles of ethylene and/or propylene oxide per mole.

* * * * *